US007946512B2

(12) United States Patent
Schorn

(10) Patent No.: US 7,946,512 B2
(45) Date of Patent: May 24, 2011

(54) SHOWERHEAD FOR A SANITARY FITTING

(75) Inventor: Franz Schorn, Schiltach (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 11/720,222

(22) PCT Filed: Nov. 30, 2005

(86) PCT No.: PCT/EP2005/012758

§ 371 (c)(1),
(2), (4) Date: Aug. 31, 2007

(87) PCT Pub. No.: WO2006/058717

PCT Pub. Date: Jun. 8, 2006

(65) Prior Publication Data

US 2008/0223957 A1 Sep. 18, 2008

(30) Foreign Application Priority Data

Dec. 1, 2004 (DE) ..... 10 2004 059 329

(51) Int. Cl.

| | |
|---|---|
| ***B05B 3/00*** | (2006.01) |
| ***B05B 3/04*** | (2006.01) |
| ***B05B 1/34*** | (2006.01) |
| ***E03C 1/08*** | (2006.01) |

(52) U.S. Cl. ..... 239/428.5; 239/225.1; 239/237; 239/240; 239/380; 239/383; 239/463

(58) Field of Classification Search ..... 239/428.5, 239/463, 468, 489, 490, 496, 518, 548, 552, 239/553.5, 225.1, 237, 240, 380, 381, 382, 239/383, 214.11, 214.13, 214.15, 214.17, 239/222.11, 222.15, 233, 243, 251, 263
See application file for complete search history.

(56) References Cited

U.S. PATENT DOCUMENTS 5,397,064 A * 3/1995 Heitzman ..... 239/99

(Continued)

FOREIGN PATENT DOCUMENTS

| | | |
|---|---|---|
| DE | 4113289 C2 | 11/1991 |
| DE | 4109001 C2 | 9/1992 |
| DE | 10016579 A1 | 12/2000 |
| GB | 2311474 A | 10/1997 |

OTHER PUBLICATIONS

German Appln. 10 2004 059 329.9 Search Report; Oct. 19, 2005.

(Continued)

*Primary Examiner* — Jason J Boeckmann
*Assistant Examiner* — Ryan Reis
(74) *Attorney, Agent, or Firm* — Duane Morris LLP

(57) ABSTRACT

A shower head for a hand-held shower attachment contains, in the center of its jet disc, an insert with three individual nozzle bodies. Each individual nozzle body is designed for discharging an individual jet. To this end, it has a continuous jet opening. Each of these in individual nozzle bodies is mounted in a manner that enables it to move relative to the shower head and to the jet disc, and is placed in rotation by a water-driven rotor. Said continuous jet opening extends at an angle to the rotation axis of the individual nozzle body. When the individual nozzle body rotates, the jet exiting there from moves on an envelope of a cone. Each individual nozzle body, contains an aerating device that aspirates the air immediately next to the outlet opening and, inside the individual nozzle body, mixes the air with the water entering this individual nozzle body. As a result, the individual nozzle body discharges an aerated jet.

14 Claims, 3 Drawing Sheets

U.S. PATENT DOCUMENTS

Figure 1:
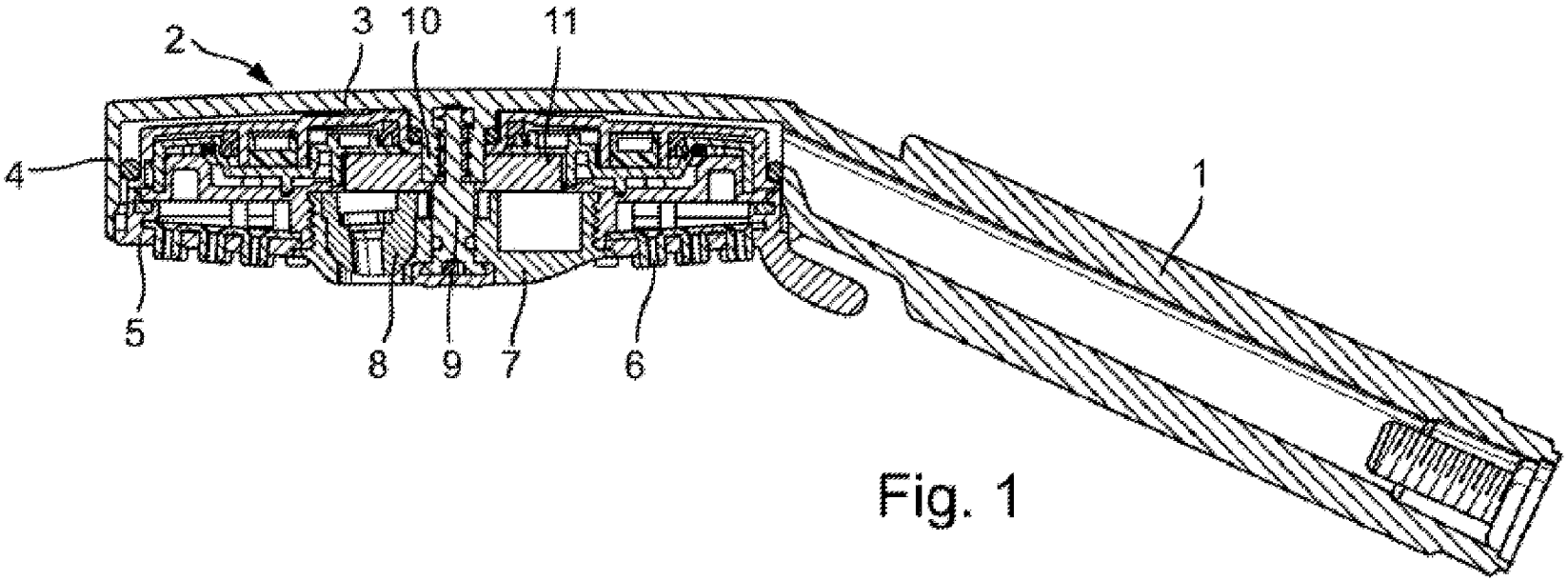

| | | | | |
|---|---|---|---|---|
| 5,862,985 | A * | 1/1999 | Neibrook et al. | 239/99 |
| 6,254,013 | B1 * | 7/2001 | Clearman et al. | 239/222.11 |
| 6,360,967 | B1 * | 3/2002 | Schorn | 239/240 |
| 7,017,837 | B2 * | 3/2006 | Taketomi et al. | 239/428.5 |
| 7,472,846 | B2 * | 1/2009 | Thomas et al. | 239/587.4 |
| 2001/0023901 | A1 | 9/2001 | Haverstraw et al. | |
| 2002/0100818 | A1 | 8/2002 | Blessing et al. | |

OTHER PUBLICATIONS

PCT/EP2005/012758 International Search Report; Apr. 26, 2006.
PCT/EP2005/012758 Written Opinion; Jun. 5, 2007.
PCT/EP2005/012758 International Preliminary Report on Patentability; Jun. 5, 2007.
Hansgrohe, "Raindance—the Design Innovation"; Feb. 5, 2006.

* cited by examiner

SHOWERHEAD FOR A SANITARY FITTING

The invention relates to a showerhead for a sanitary fitting.

There is a large number of possible types of showerheads which can form increasingly complex jet patterns in order to satisfy customers needs.

It is known that one can switch between different jet types of showerheads, for instance, hard massage jets, soft aerated jets, or also pulsating jets. Jets that change direction are also known.

Aerated jets are normally generated from jet outlet elements that are arranged at a certain point in the jet disc.

The task of the invention is to create a small showerhead for a sanitary fitting with wherein further design possibilities of jet patterns arise.

To solve this task, the invention proposes a showerhead with the features mentioned in claim 1. Developments of the invention are subject of the subordinate claims.

For the first time it is now possible to produce aerated jets from an individual nozzle body, which is displaceably mounted or held relative to the showerhead. Under an individual nozzle body, an element should be understood that, for instance, features a single jet outlet nozzle, if necessary also a second or third one.

In case several individual nozzle bodies are present, each of these individual nozzle bodies features its own aerating device.

In a further development of the invention, it can be provided that the individual nozzle body is held in the showerhead housing and/or in the jet disc.

For instance, in a further development it can be provided that the individual nozzle body is held in an insert of the showerhead housing. It can thereby be disposed and formed independently of the jet disc.

For instance, the individual nozzle body can be mounted freely or so that it orientates itself according to the water flow conditions, for instance, also oscillating.

It is however particularly convenient, in a further development of the invention if the individual nozzle body is mounted so that it can execute a certain motion, for which it features a forced drive. For instance, a turbine can be provided to drive the individual nozzle body rotationally. This turbine, of course, is driven by the water flowing through the showerhead.

In particular, the support can be designed so that the individual nozzle body changes the direction of the shower jet coming out of it during its motion. For instance, the shower jet could move on a cone envelope.

In order to design the showerhead with a particularly small volume, in a further development according to the invention, it can be provided that the aerating device of the individual nozzle body features at least an air channel running through the individual nozzle body. This serves the purpose that the air is sucked from outside the showerhead housing and brought into the water jet through an individual nozzle body.

In particular, it can be provided that the air channel runs parallel to the jet channel and features a smaller cross-section than same.

According to the invention, it can be provided in a further development that the air channel discharges into a mixing chamber of the individual nozzle body. This mixing chamber formed inside the individual nozzle body can feature a border in the form of a distributing plate, which in a further development features several holes on its inlet side. The holes divide the water jet before it enters the mixing chamber, and causes the Venturi-effect, in that manner, for sucking air.

In particular, the distributing plate can lie on a step inside the individual nozzle body, underneath which at least one air channel exits.

It is naturally particularly convenient if several air channels are disposed in the individual nozzle body, which are preferably disposed uniformly around the jet channel.

According to the invention, the showerhead can feature several individual nozzle bodies that can be driven concurrently in order to generate interesting jet patterns.

It is reasonable and within the scope of the invention that at least an individual nozzle body is provided with additional further jet outlet elements.

The individual nozzle body or in case of several individual nozzle bodies, all individual nozzle bodies preferably produce jets in the same direction as the other jet outlet elements of the jet disc.

Figure 2:
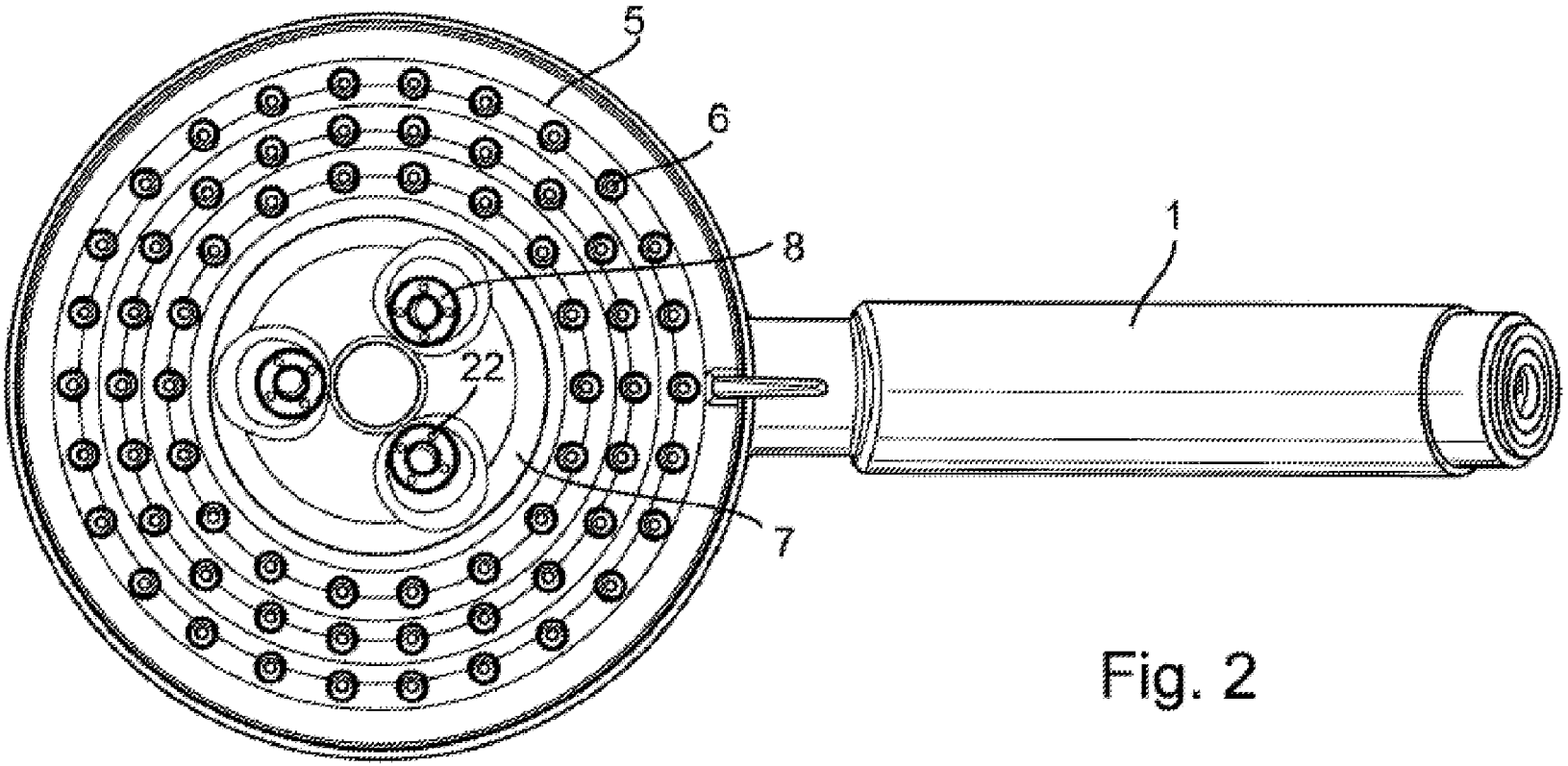
Figure 3:
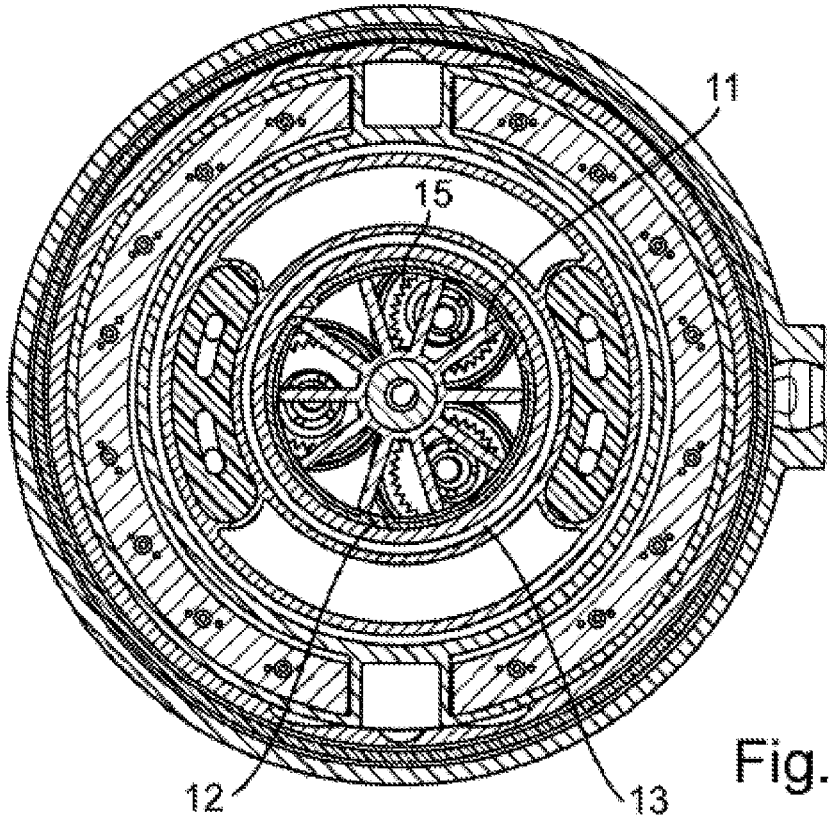
Figure 4:
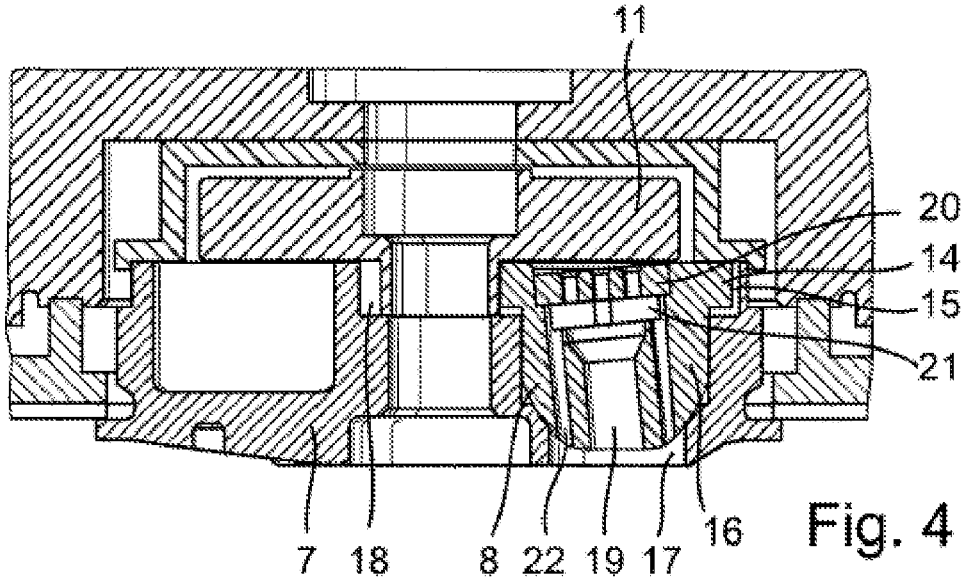

Further features, details and preferences of the invention are derived from the claims and abstract whose wording is based on reference to the content of the description, of the following description of a preferred embodiment of the invention and of the drawing. The figures show:

FIG. 1 shows a section through a hand-held showerhead with a showerhead according to the invention;

FIG. 2 a front view of the hand-held showerhead of FIG. 1 from below in FIG. 1;

FIG. 3 a cross-section through the showerhead of FIGS. 1 and 2 and,

FIG. 4 in magnified scale, a section through the arrangement of an individual nozzle body, which is set in rotation by a turbine.

FIG. 1 shows a hand-held showerhead with a grip 1 in longitudinal section and a showerhead housing 2. The showerhead housing 2 contains a flat housing floor 3, which has a boundary along its circumference through a flat cylindrical jacket 4. This defines the internal space of the showerhead housing 2. This internal space is limited by a jet disc 5 on the side facing away from the housing floor 3, with three concentric rows of jet outlet elements 6 in the depicted example features. In the centre of the jet disc an insert 7 is firmly screwed in the showerhead housing, which then forms a kind of core of the jet disc 5. Three individual nozzle bodies 8 are disposed in this insert 7. These individual nozzle bodies 8 are also visible in the plan view of FIG. 2.

The insert 7 is fastened in the showerhead housing with the help of a screw 9, which is screwed in a centre projection 10 of the showerhead housing 2. Around this centre projection 10 a turbine wheel 11 is mounted pivotally and features a hub with external teeth. This will become more visible in the following passage.

The water enters the interior of the showerhead housing through the grip 1 and in the interior of the showerhead housing through a series of guiding means to the jet outlet elements 6 or to the turbine wheel 11 in the centre.

The three individual nozzle bodies 8 are uniformly offset, see the plan view of FIG. 2.

FIG. 3 now shows a section through the middle of the showerhead housing 2. Here, it is visible that the rotor 11 features ten turbine vanes, which are provided with water jets through obliquely aligned slits 12 in a jacket. The water reaches a ring-space 13 outside this jacket and from there through the slits 12 to the space where the turbine 11 is mounted.

Now regarding FIG. 4. Here, one of the individual nozzle bodies 8 is depicted in an axial section. The individual nozzle body 8 features a revolving flange 14 with external teeth 15 on its one end directed towards the interior of the showerhead housing 2. These external teeth 15 can also be seen in the section of FIG. 3. A cylindrical section 16 adjoins the flange 14, which then transforms into a semi-spherical section.

The individual nozzle body 8 is accommodated in a receptacle of the insert 7, which is formed somewhat complementarily to the external shape of the individual nozzle body 8. In its cylindrical section 16, the individual nozzle body 8 thus lies on a cylindrical wall of the receptacle whilst the semi-spherical section lies on a ring surface. The front section of the individual nozzle body 8 is in a cutout 17 of the insert 7, and is thus open outwardly.

The external teeth 15 of the flange 14 of the individual nozzle body 8 comes with external teeth 18 on the hub of the rotor 11, which is likewise visible in the section of FIG. 3. The rotor 11 is pivotally mounted in the insert.

If the rotor 11 is set in rotation by flowing water, the individual nozzle bodies 8 are set in rotation about the fixed rotational axis determined by the receptacle.

In the individual nozzle bodies 8 a stepped internal opening 19 is provided, whose longitudinal axis runs obliquely to the symmetry axis of the individual nozzle body 8. By rotating the individual nozzle body 8, the axis of the internal opening 19 moves on a cone envelope.

The internal opening 19 begins from the side directed away from the interior of the showerhead housing 2 of the individual nozzle body 8 with a first section that is terminated by a step. A distributing disc 20, with several individual openings, lies on this step. On the step on which the distributing disc 20 lies, a mixing chamber 21 is adjoined, which then comprises a diametrical constriction with a step. In this mixing chamber 21, four air channels 22 run parallel to the internal opening 19 exit from the front side of the individual nozzle body 8. These small air channels 22 are also visible in FIG. 2.

When the water flows through the holes of the distributing disc 20 in the interior opening 19 of the individual nozzle body 8, it sucks air from the air channels 22 from the outside of the showerhead housing and carries it in the jet guided through the interior opening 19. This aspiration of air and aeration of the exiting jet is independent of the rotation of the rotor. With a rotating rotor and water jet that constantly change in direction, a particularly interesting jet pattern is created.

What is claimed is:

1. A showerhead for a sanitary fitting, comprising: a showerhead housing, a water inlet line defined in the showerhead housing, a jet disc configured for at least one jet outlet provided with water from the water inlet line, at least an individual nozzle body held movably relative to at least one of the jet disc and the showerhead housing, wherein the individual nozzle body has its own aeration device only for aerating a shower jet exiting from said individual nozzle body, and wherein the individual nozzle body is driven forcibly to move, by a turbine; wherein the aeration device of the individual nozzle body includes an air channel opening at a front face on the exit side of the individual nozzle body and running through the individual nozzle body; and, wherein the air channel runs parallel to a jet channel of the nozzle body and has a smaller cross-section than the jet channel.

2. The showerhead according to claim 1, wherein the individual nozzle body is held in said at least one of the showerhead housing and the jet disc.

3. The showerhead according to claim 1, wherein the individual nozzle body is held in an insert of the showerhead housing.

4. The showerhead according to claim 1, wherein the individual nozzle body is held so as to be freely movable.

5. The showerhead according to claim 1, wherein the individual nozzle body is configured such that the shower jet exiting from the individual nozzle body changes its direction relative to the showerhead during motion of the individual nozzle body.

6. The showerhead according to claim 1, wherein the air channel discharges into a mixing chamber of the individual nozzle body.

7. A showerhead for a sanitary fitting, comprising: a showerhead housing, a water inlet line defined in the showerhead housing, a jet disc configured for at least one jet outlet provided with water from the water inlet line, at least an individual nozzle body held movably relative to at least one of the jet disc and the showerhead housing, wherein the individual nozzle body has its own aeration device only for aerating a shower jet exiting from said individual nozzle body, and wherein the individual nozzle body is driven forcibly to move, by a turbine; wherein the aeration device of the individual nozzle body includes an air channel opening at a front face on the exit side of the individual nozzle body and running through the individual nozzle body; wherein the air channel discharges into a mixing chamber of the individual nozzle body; and, wherein the mixing chamber is bound upstream by a distributing plate with several holes.

8. The showerhead according to claim 7, wherein the distributing plate lies on a step in the individual nozzle body, underneath of which at least one air channel discharges.

9. The showerhead according to claim 1, wherein the aeration device comprises several air channels distributed around a jet channel of the shower jet.

10. A showerhead for a sanitary fitting, comprising:

a showerhead housing, a water inlet line defined in the showerhead housing, a jet disc configured for at least one jet outlet provided with water from the water inlet line, plural individual nozzle bodies, each of said individual nozzle bodies being held movably relative to at least one of the jet disc and the showerhead housing, wherein each said individual nozzle body has its own aeration device only for aerating a shower jet exiting from said individual nozzle body, wherein the plural individual nozzle bodies are driven forcibly to move by a turbine; and wherein the aeration device of each said individual nozzle body includes an air channel opening at a front face of the individual nozzle body and running through the individual nozzle body.

11. The showerhead according to claim 10, wherein several of the individual nozzle bodies are configured to be driven concurrently.

12. The showerhead according to claim 1, wherein the at least one individual nozzle body is usable concurrently with further jet outlet elements.

13. The showerhead according to claim 12, wherein the individual nozzle body jets in a same direction as the further jet outlet elements of the jet disc.

14. The showerhead according to claim 1, wherein the individual nozzle body is driven rotationally by the water from the water inlet line, passing through the turbine.

* * * * *